United States Patent [19]

Karlsson

[11] Patent Number: 4,516,640

[45] Date of Patent: May 14, 1985

[54] ROTARY DRILL BIT

[75] Inventor: Harry L. Karlsson, Sandviken, Sweden

[73] Assignee: Santrade Ltd., Switzerland

[21] Appl. No.: 559,483

[22] Filed: Dec. 8, 1983

[51] Int. Cl.[3] ..... E21B 10/22

[52] U.S. Cl. ..... 175/227; 175/337; 175/371; 384/94

[58] Field of Search ..... 175/227, 337, 339, 340, 175/371; 384/93, 94

[56] References Cited

U.S. PATENT DOCUMENTS

| | | | |
|---|---|---|---|
| 3,125,175 | 3/1964 | Medlock et al. | 175/337 |
| 4,298,079 | 11/1981 | Norlander et al. | 175/339 |
| 4,306,727 | 12/1981 | Deane et al. | 175/371 |
| 4,386,668 | 6/1983 | Parish | 384/94 |
| 4,421,184 | 12/1983 | Mullins | 175/371 |
| 4,427,307 | 1/1984 | Norlander et al. | 384/93 |
| 4,466,622 | 8/1984 | Deane et al. | 175/371 |

FOREIGN PATENT DOCUMENTS

| | | |
|---|---|---|
| WO82/01909 | 6/1982 | PCT Int'l Appl. . |
| 816742 | 9/1982 | South Africa . |

*Primary Examiner*—Stephen J. Novosad
*Assistant Examiner*—William P. Neuder
*Attorney, Agent, or Firm*—Burns, Doane, Swecker & Mathis

[57] ABSTRACT

The present invention relates to an improved rotary drill bit having a bit body with at least one bearing pin attached thereto for rotatably carrying a roller cutter over a bearing system. The bearing system includes at least a forward bearing and a rear bearing with at least one inflow passage provided in the bit body for supplying fluid through the passage to the rear bearing during operation of the bit for flushing and for cooling of the rear bearing. The passage terminates in the bearing system ahead of a forward end of the rear bearing between an intermediate sealing arrangement and an annular outlet gap provided between the bit body and the roller cutter. The bearing pin includes a flange for axially fixing a forward end of the rear roller bearings with the inflow passage preferably terminating on the periphery of the flange. The sealing arrangement preferably engages a forward radial surface of the flange on the bearing pin. In accordance with a further aspect of the present invention, a particular sealing arrangement is provided which more effectively seals the forward bearing space from the rear bearing space. Further, the arrangement of the various elements of the bearing system are adapted to minimize the amount of space required.

19 Claims, 3 Drawing Figures

ROTARY DRILL BIT

BACKGROUND AND SUMMARY OF THE PRESENT INVENTION

The present invention relates to an improved rotary drill bit having a bit body with at least one bearing pin attached thereto for rotatably carrying a roller cutter. More particularly, the present invention relates to an improved lubricating and cooling system for the cutter and an arrangement for axially fixing the cutter relative to the bearing pin.

In rotary drill bits, it is common to utilize conical roller cutters which are rotatably carried on bearing pins of the bit body over a bearing system. Satisfactory lubrication and cooling of the bearing system is particularly important. Accordingly, it has been suggested to seal the bearing space at an annular gap formed between the roller cutter and the bit body and to fill the space with a suitable lubricant. However, during operation of such a sealed lubrication system, there is a risk that impurities may penetrate past the seal and enter into the bearing system. Such impurities may cause severe mechanical damage to the bearings. Sealed bearing systems of this type are generally disclosed, for example, in U.S. Pat. Nos. 3,127,942 issued Apr. 7, 1964 to Neilson; 3,964,554 issued June 22, 1976 to Ricks et al; 4,249,781 issued Feb. 10, 1981 to Olschewski et al; 4,298,079 issued Nov. 3, 1981 to Norlander et al; and 4,367,904 issued Jan. 11, 1983 to Olschewski et al.

An alternate proposal has been to provide a continuously flowing fluid, such as air, possibly with an oil mist, to the bearing system in order to avoid the entrance of impurities into the bearing system. However, such a continuously flowing system may not provide sufficient lubrication under all operating conditions of the bit, particularly in a forward portion of the bearing system. An open bearing lubrication system of this general type is disclosed, for example, in U.S. Pat. No. 4,194,794, issued Mar. 25, 1980 to Kling.

It has also been proposed to combine a closed and an open bearing lubrication system within a single rotary rock drill bit. One such combined system is disclosed in U.S. Pat. No. 4,211,453 issued July 8, 1980 to Johansson. In the Johansson patent, the conical cutting elements are secured to a bit segment by annular locking bearings. The locking bearings are fed by a first lubricating system which forces a fluid, preferably water, through angled passages in the bit body and the bit segment past the locking bearings to be expelled externally of the drill bit. A unitary annular seal is provided ahead of the locking bearings for sealing a forward portion of the bearing system including further annular bearings. The forward portion defines a closed space filled with lubricant. Such an arrangement may suffer from the problem of maintaining the integrity of the internal annular seal and ensuring that sufficient cooling of the entire bearing system is accomplished.

A further combined sealed and unsealed lubrication system for rock drill bit bearings is disclosed in U.S. Pat. No. 4,386,668 issued June 7, 1983 to Parish. In the Parish patent, air is supplied through an angled passage in a bearing pin for lubricating a rear bearing of the bearing system. The passage terminates approximately midway on the rear roller bearings to permit fluid to flow rearwardly toward an annular gap between the cutter and the bit body. The cutter is secured on the bit body by a snap ring arranged behind a simple O-ring seal for separating the bearing system into a rear bearing space and a forward bearing space portion. The forward bearing space is filled with lubricant and sealed. Also, a pressure compensating device for the forward bearing space is essential due to the expected rise in the temperature of the lubricant within the forward bearing space. The seal between the forward and rear bearing in the Parish patent is subjected to a substantial amount of heat and friction during operation of the bit. Such heat and friction may cause unacceptable wear on the seal thereby permitting an undesirable amount of leakage of the fluid from the forward bearing space outwardly through the rear bearing. Further, since the air lubricating passage terminates approximately midway on the rollers of the rear bearing, there is no assurance that the entire length of the rear bearing rollers is properly cooled and flushed.

Efforts have also been undertaken in the prior art to develop particularly effective seals for use in rotary drill bits or cutting heads. Such prior art seals include metallic rings biased by an elastomeric element, such as an O-ring, against the surface to be sealed. In other words, the seal is effected between the metal sealing rings and the metal surface. Sealing arrangements of this general type are disclosed in U.S. Pat. No. 3,858,670 issued Jan. 7, 1975 to Ott et al and the aforementioned U.S. Pat. No. 4,367,904 of Olschewski et al. The use of such a seal in a combined open and closed lubrication system, where space considerations are extremely critical, has not been suggested. A further type of seal is disclosed in the previously cited U.S. Pat. No. 4,298,079 issued to Norlander et al. In the Norlander et al patent, a sealing element includes an elastically yieldable tongue biased to a closed position by air pressure. The tongue operates as a first element for preventing the entrance of impurities prior to the impurities reaching the main portion of the seal.

Still further developments have occurred in the prior art for effective arrangements for axially securing a roller cutter element to a bearing pin. In general, the cutting elements are secured by ball bearings (see U.S. Pat. Nos. 3,127,942, 3,964,554 and 4,221,453) or by a snap ring as in the Parish patent discussed above. It has also been suggested to retain the cutting element on the bearing pin by utilizing a set of roller bearings, for example, the rear roller bearings, as shown, in the aforementioned U.S. Pat. Nos. 4,298,079 and 4,256,193.

While numerous advancements have been made in various aspects of rotary drill bit construction, there is still room for improvement. Accordingly, it is an object of the present invention to provide such an improved rotary drill bit which overcomes the various disadvantages of the prior art systems. In particular, it is an object of the present invention to provide a rotary drill bit which includes a highly efficient and effective lubrication and cooling system. The lubrication and cooling system according to the present invention ensures adequate lubrication, prevents the entrance of impurities into the bearing system and effectively cools the entire bearing system. Moreover, the present invention provides an improved sealing arrangement within the bearing system for aiding in accomplishing these objects. Still further, the arrangement according to the present invention is adaptable to existing drill bits without decreasing the overall diameter of the drill bit thereby retaining the full load carrying capacity of the roller cutting elements.

These objects and others are accomplished by a rotary drill bit according to the present invention having at least one roller cutter which is rotatably carried on a bearing pin over a bearing system. The bearing system includes at least a forward bearing and a rear bearing which is a roller bearing. At least one inflow passage is provided in the bit body through which fluid is supplied to the rear bearing during operation of the bit for flushing and for aiding cooling of the rear bearing. The passage terminates in the bearing system ahead of a forward end of the rear bearing between an intermediate sealing arrangement and an outflow passage, preferably in the form of an annular gap provided between the bit body and the roller cutter. The sealing arrangement separates the bearing system into a forward bearing space and a rear bearing space with the forward bearing space being filled with lubricant.

Since the rear bearing lubrication passage terminates ahead of the forward end of the rear bearing rollers, proper lubrication, flushing and cooling of the entire axial length of the rollers is ensured. In accordance with a further aspect of the present invention, the bearing pin includes a flange for axially fixing a forward end of the rollers of the rear bearing with the fluid passage including at least one radially extending passage arranged within the flange. In this way, more effective cooling of the bearing pin, particularly the flange, is accomplished. In particular, since the inflow passage extends further forward in an axial direction than the prior art, more of the bearing pin is cooled by the flowing fluid. Also, by cooling the bearing pin, the lubricant contained within the forward bearing space is also maintained at a lower temperature to reduce expansion of the lubricant therein. In accordance with a further aspect of the present invention, the sealing arrangement is sealed against a forward radial surface of the flange. This arrangement promotes effective cooling of the sealing arrangement due to the proximity of the outlets of the radial passages within the flange to the sealing arrangement.

In a preferred embodiment, the radially extending passages open into the bearing system on an outer peripheral surface of the flange. Further, in a particularly preferred embodiment, six equally angularly spaced radial passages are provided in the flange to more effectively cool both the bearing pin and hence the lubricant within the forward bearing space. Also, the six radial passages more evenly distribute the lubricating air flow to the rear bearing. Still further, the six radial passages are preferably supplied by a single axial passage in the bearing pin in order to reduce the velocity of the air flow through the rear bearing space. In this way, it is ensured that the oil mist entrained within the air flow adheres to the bearing races. If the velocity of the air is too great, the oil tends to be removed or stripped from the bearing races.

Still further in the preferred embodiment, the sealing arrangement includes an angular metallic sealing ring and an elastomeric element for biasing the sealing ring against the forward radial surface of the flange. The elastomeric element is arranged between the sealing ring and an internal surface of the roller cutter such that the elastomeric element remains stationary with respect to both the ring and the cutter.

In accordance with still a further aspect of the present invention, an axial bearing is provided in the forward bearing. The sealing arrangement partially overlaps the axial bearing, which is preferably comprised of a plurality of cylindrical rollers, in an axial direction. In this way, the overall diameter of the roller cutter is not reduced. Moreover, the flange on the bearing pin preferably has a relatively short axial length and the arrangement of the particular seal in overlapping relationship with the axial bearings further reduces the axial space required for these additional elements.

Due to the requirements of maintaining the overall dimensions of the rollers constant, and due to the provision of the flange and the additional seal between the forward and rear bearing spaces, there is insufficient room to provide a locking roller in the form of a ball bearing or a snap ring for axially retaining the cutter as in many of the prior art rotary cutters. In accordance with the present invention, the rollers of the rear bearing, which are axially fixed at a forward end by a rearward surface of the flange, serve to axially fix the roller cutter on the bearing pin. In the preferred embodiment, the axial fixing is accomplished by cooperation of the rear bearing rollers with a shoulder on a rear portion of the roller cutter which shoulder engages a rear end of the rollers of the rear bearing.

BRIEF DESCRIPTION OF THE DRAWINGS

Preferred embodiments of the present invention will be described in greater detail with reference to the accompanying drawings, wherein like members bear like reference numerals and wherein.

DETAILED DESCRIPTION OF THE PREFERRED EMBODIMENTS

Figure 1:
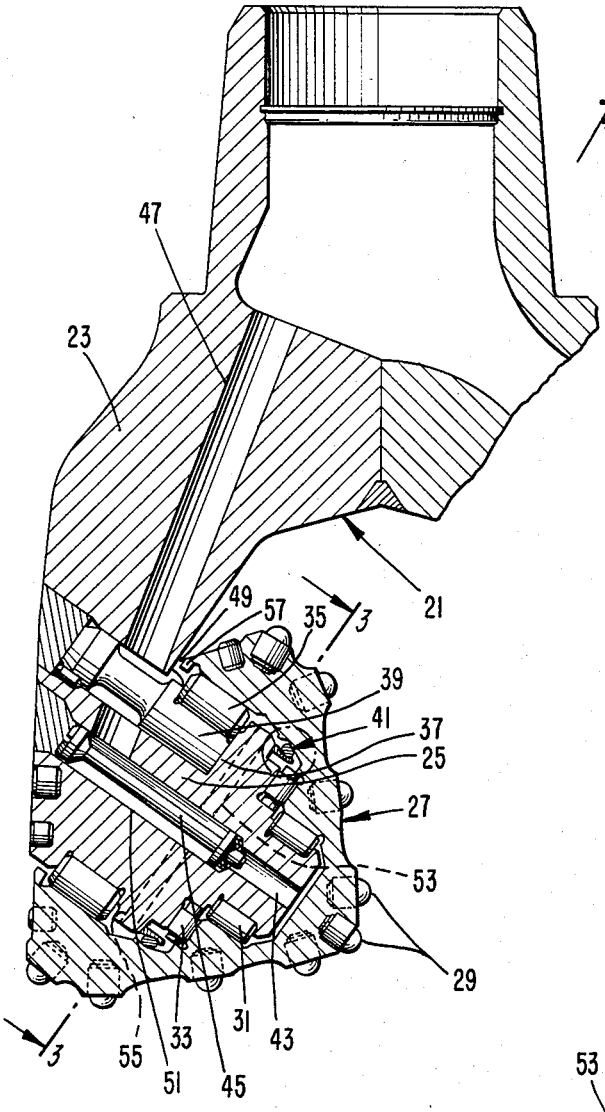
FIG. 1 is a cross-sectional view of a portion of a rotary drill bit according to the present invention.

With reference to FIG. 1, a drill bit for rotary drilling, for example, in rock and earth formations, includes three separate legs which form part of a bit body 21. A rotary drill bit of this general type is disclosed, for example, in U.S. Pat. No. 4,194,794 issued Mar. 25, 1980 to Kling. For the sake of clarity, only one leg 23 is illustrated in FIG. 1. A lowermost portion of the leg 23 is formed as a bearing pin 25 upon which a roller cutter 27 is rotatably carried. The roller cutter 27 is provided with a plurality of cutting elements 29. In the illustrated embodiment, the cutting elements 29 are comprised of hard metal inserts which are pressed fitted into corresponding holes in the roller cutter 27. Other cutting element arrangements may be utilized if desired. The cutting inserts 29 break and crush rocks and earth formations when the drill bit is rotated and moved downward in a hole being drilled.

A bearing system for rotatably supporting the roller cutter 27 includes a forward bearing 31 comprised of a plurality of cylindrical rollers at the top of the roller cutter 27, i.e., the forward end of the roller cutter 27 opposite the leg 23. The bearing system further includes an axial bearing 33 comprised of a plurality of cylindrical roller bearings arranged with their axes generally perpendicular to the axis of the bearing pin 25 and a rear bearing 35 also comprised of a plurality of roller bearings. The rollers of the rear roller bearing 35 are inserted through a loading bore 37 in the leg 23 when the roller cutter 27 is mounted on the bearing pin 25. Thereafter, a plug 39 is inserted into the bore 37 and secured therein, for example, by welding.

A sealing arrangement 41 is provided between the axial bearing 33 and the rear bearing 35 for sealingly separating a forward bearing space including the axial bearing 33 and the forward bearing 31 from a rear bearing space including the rear roller bearing 35. The forward bearing space is filled with lubricant, for example, through an axial passage 43 in the bearing pin 25. Thereafter, the space is sealed by a suitable sealing element 45. Alternatively, the forward bearing space may be filled by a lubricating system (not shown) which in a known manner includes a pressure compensator for equalizing the pressures in the lubricant and the fluid in the drill hole. The lubricant in the forward bearing space is chosen for proper operation at the high working temperatures which arise at the top or forward end of the roller cutter 27.

An inflow passage 47 is provided in the leg 23 for supplying fluid, such as compressed air, possibly mixed with an oil mist, to the rear bearing space including the rear bearing 35. This fluid is intended both to cool the rear bearing 35 and also to flush or clean the rear bearing 35 and rear bearing space. The continuously flowing fluid also serves to prevent impurities from entering into the rear bearing space through an annular gap 49 provided between the roller cutter 27 and the leg 23 of the bit body during operation of the drill bit. In other words, a constant flow of fluid is established from the inflow passage 47 through the rear bearing space past the rear bearing 35 to the outflow passage 49. Due to this constant flow, the risk of impurities entering the bearing system, particularly the rear bearing 35, is greatly reduced. In certain cases, the fluid may be at the same temperature or warmer than the rear bearing rollers 35 such that the primary function of the flowing fluid is to lubricate and clean or flush the rear bearing space.

It should be noted that the present invention provides a combined sealed and unsealed bearing system for the roller cutter 27. In other words, the forward bearing space is sealed and contains a predetermined amount of lubricant while the rear bearing space is continuously supplied with a flowing fluid for lubricating and flushing the rear bearing space.

The fluid in the passage 47 in the leg 23 is conducted into the bearing pin 25 past the plug 39 into an axial bore 51 in the bearing pin 25. A plurality of radially extending passages 53 communicate with the axial bore 51 near a forward end thereof. The axially extending passages 53 conduct fluid outwardly to the periphery of the bearing pin 25 to deliver the fluid to the rear bearing space.

Figure 3:
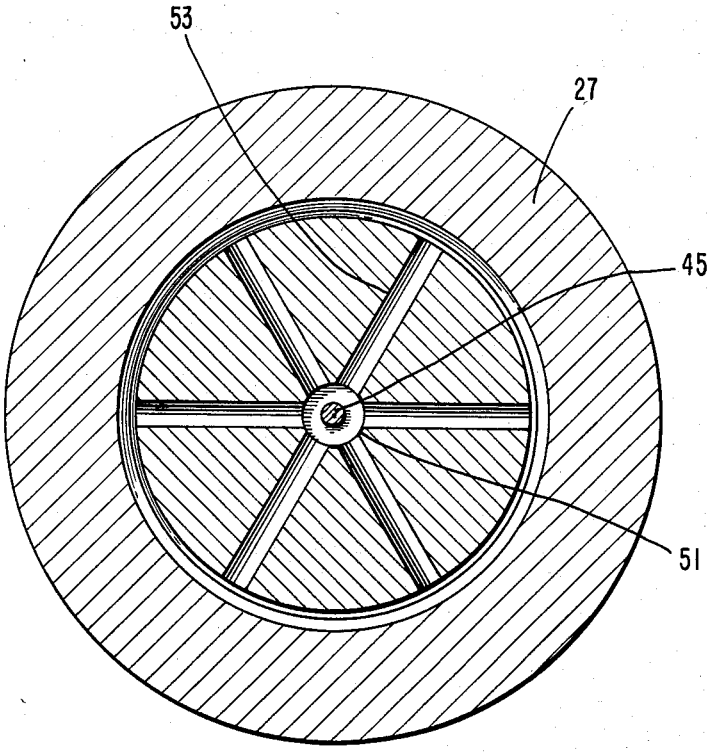
FIG. 3 is a cross-sectional view taken along the line 3—3 in FIG. 1.

With reference to FIG. 3, in a preferred embodiment at least four and, in an especially preferred embodiment six equally angularly spaced radially extending passages 53 are provided in the bearing pin 25. In this way, better distribution of the fluid around the entire circumference of the bearing pin 25 is ensured. Also, by separating the flow in the axial bore 51 into four separate flows in the radially extending passages 53, the velocity of the fluid flow is reduced. In this way, the oil, carried in the form of a mist with the air flow, more easily adheres to the races of the rear roller bearing 35. In other words, the reduced velocity of the air flow prevents the oil from being carried out with the air as may occur with a too high velocity air flow.

It should be noted that the openings of the radially extending passages 53 into the bearing space are arranged between the sealing arrangement 41 and a forward end of the rollers of the rear bearing 35. In this way, fluid flow along the entire axial length of the rear roller bearing 35 is ensured. Also, the proximity of the openings of the radially extending passages 53 to the sealing arrangement 41 aids in maintaining the sealing surfaces of the sealing arrangement 41 free of impurities. Still further, the flow fluid in the radial passages also aids in cooling the bearing pin 25. This cooling of the bearing pin 25 is enhanced by the substantial axial length of the inflow axial passage 51. In other words, since the axial passage 51, in addition to the radial passages 53, extends close to the forward end of the bearing pin 25, cooling of the bearing pin 25 is improved. This reduced temperature of the bearing pin 25 tends to reduce the temperature of the lubricant in the forward bearing space. In this way, excessive expansion of the lubricant is avoided and hence a pressure compensating arrangement is not required.

The radially extending passages 53 are preferably provided in a flange 55 on the bearing pin 25. The flange 55 not only carries the radially extending passages 53 with their openings in the outer peripheral surface of the flange, but also serves two other important functions. The rearward surface of the flange 55 engages a forward end of the rear bearing 35 to axially fix the rear bearing rollers. Also, a forward radial surface 63 of the flange 55 serves as a sealing surface for the sealing arrangement 41.

Since the overall diameter of the drill bit cannot easily be increased, the axial length of the flange is made as small as possible to permit sufficiently long rollers to be employed for the various bearings. However, the provision of the flange 55 with the passages 53 therein, decreases the axial length of the bearing pin 25 available for securing the roller cutter 27 thereto. In accordance with the present invention, this lack of axial space is overcome by arranging the rear roller bearing 35 to fix the roller cutter 27 relative to the bearing pin 25. This fixing is accomplished by engagement of a shoulder 57 on a rear portion of the roller cutter 27 with a rear end of the rollers of the rear bearing 35. Accordingly, since the forward end of the rear bearing 35 is fixed by the rearward surface of the flange 55, the engagement of the shoulder 57 on the roller cutter 27 with the rear end of the rear bearing rollers fixes the roller cutter 27 axially relative to the bearing pin 25.

Figure 2:
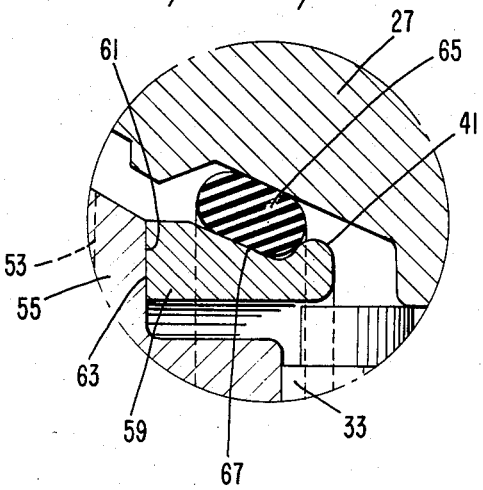
FIG. 2 is an enlarged view of the encircled portion labeled A in FIG. 1.

With reference to FIG. 2, the sealing arrangement 41 includes an annular metallic sealing ring 59. A radial surface 61 of the sealing ring 59 engages the forward radial surface 63 of the flange 55. An elastomeric element 65, such as an O-ring, is arranged within a groove 67 provided in an exterior surface of the sealing ring 59. The elastomeric element 65 is slightly compressed between the sealing ring 59 and an interior surface of the roller cutter 27 to resiliently bias the sealing ring surface 61 against the forward radial surface 63 of the flange 55 to effectuate a seal. It should be noted that the elastomeric element 65 is stationary with respect to both the sealing ring 59 and the roller cutter 27. In other words, the sliding contact occasioned by rotation of the roller cutter 27 occurs between the sealing ring surface 61 and the flange surface 63 rather than causing constant sliding friction against the O-ring 65. Due to the constraints noted previously on the overall dimensions of the bearing pin and the drill bit, the sealing arrangement 41 is adapted to axially overlap the axial bearing rollers 33 to reduce the additional axial length necessary for installing the sealing arrangement.

The sealing arrangement 41 according to the present invention provides numerous advantages over a simple O-ring seal. Since the elastomeric element 65 is stationary relative to both the roller cutter 27 and the metallic sealing ring 59, the elastomeric element 65 provides a static seal against the roller cutter 27 to prevent passage of lubricant therethrough while effectively biasing the sealing ring 59 against the flange 55. The static seal greatly improves the life expectancy of the O-ring over that expected when the O-ring is subjected to constant sliding friction. Further, if a small increase in volume of the lubricant sealed in the forward bearing space occurs due to a slight increase in the temperature of the lubricant, surplus lubricant may more easily escape between the sealing surfaces of the metallic ring 59 and the flange 55 than around a single O-ring seal. Further, small impurities in the front bearing space, for instance small particles of the bearing races therein, may pass the sealing arrangement 41 without substantially damaging the sealing surfaces. In contrast, if a simple O-ring were utilized, severe damage would be caused by such particles. Also, as noted before, the proximity of the sealing arrangement 41 to the radially extending passages 53 (through which a fluid is contantly flowing) further serves to ensure that the impurities around the sealing surfaces of the sealing arrangement 41 are eliminated. Moreover, the fluid flow from the radial passages 53 serves to cool the sealing arrangement 41 and the lubricant adjacent thereto in the forward bearing space.

As can be appreciated, the present invention provides a rotary drill bit which offers substantial advantages over the prior art. Effective lubrication and cooling of all part of the bearing system are ensured due to the combination of a closed lubrication system for the forward bearing space and an open, continuous flushing system for the rear bearing space. Further, a sealing arrangement for separating the bearing spaces is particularly adapted for both long life and effective sealing. Still further, each of the components within the bearing system are arranged to minimize the amount of axial space required, thereby eliminating the need to alter the external dimensions of the drill bit or reduce the size, and hence the load carrying capacity of the rollers of any of the bearings. Still further, the provision of a plurality of radially extending passages for delivering the flushing and cooling fluid to the rear bearing space provides additional cooling for both the sealing arrangement and the bearing pin as well as ensuring a flow over the entire axial length of the rear bearing rollers.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A rotary drill bit comprising at least one roller cutter which is rotatably carried on a bearing pin over a bearing system, said bearing system comprising at least a forward bearing and a rear bearing, said rear bearing being a roller bearing, at least one inflow passage being provided in a bit body, at least one outflow passage, means for supplying fluid through the at least one inflow passage to the rear bearing during operation of the bit to establish a flow of the fluid from the inflow to the outflow passage for flushing and for aiding cooling of the rear bearing, the bearing pin including a flange for axially fixing a forward end of the rollers of the rear bearing, said inflow passage including a plurality of radially extending passages arranged in the flange, the radially extending passage terminating in the bearing system ahead of the forward end of the rear bearing between intermediate sealing means and the outflow passage, said sealing means separating the bearing system into a forward bearing space and a rear bearing space, and the forward bearing space being filled with lubricant.

2. The rotary drill bit of claim 1, wherein the rear bearing is axially fixed by a rear surface of the flange and the sealing means cooperates with a forward radial surface of the flange.

3. The rotary drill bit of claim 1, wherein the at least one radially extending passage opens into the bearing system on an outer peripheral surface of the flange.

4. The rotary drill bit of claim 1, wherein the outflow passage is arranged behind a rear end of the rear bearing to ensure flushing of the entire axial length of the rear bearing.

5. The rotary drill bit of claim 1, wherein at least four equally angularly spaced radially extending passages are provided in the flange.

6. The rotary drill bit of claim 1, wherein six equally angularly spaced radially extending passages are provided in the flange.

7. The rotary drill bit of claim 6, wherein the inflow passage includes a single axial passage for supplying fluid to the six radially extending passages.

8. The rotary drill bit of claim 1, wherein the outflow passage comprises an annular gap provided between the bit body and the roller cutter.

9. The rotary drill bit of claim 1, wherein the fluid supplied to the rear bearing is compressed air.

10. The rotary drill bit of claim 9, further comprising oil in the form of a mist carried by the compressed air.

11. A rotary drill bit comprising a bit body having at least one bearing pin attached thereto, a roller cutter which is rotatably carried on the bearing pin over a bearing system, said bearing system comprising at least a forward bearing and a rear bearing, at least one inflow passage being provided in a bit body, means for supplying fluid through the passage to the rear bearing during operation of the bit for flushing and for aiding cooling of the rear bearing, the passage terminating in the bearing system ahead of a forward end of the rear bearing between intermediate sealing means and an annular outlet gap for the fluid provided between the bit body and the roller cutter, said rear bearing being a roller bearing and the bearing pin including a radially extending flange for fixing the forward end of the rollers of the rear bearing, said sealing means sealing against a forward radial surface of the flange and separating said bearing system into a forward bearing space and a rear bearing space, the forward bearing space being filled with lubricant.

12. The rotary drill bit of claim 11, wherein the inflow passage includes a plurality of radially extending passages in the flange, the passages terminating in the bearing system adjacent the sealing means to provide cooling of the sealing means.

13. The rotary drill bit of claim 11, wherein the sealing means includes an annular metallic sealing ring and an elastomeric element for biasing the sealing ring against the forward radial surface of the flange.

14. The rotary drill bit of claim 13, wherein the elastomeric element is arranged between the sealing ring and an inside surface of the roller cutter and is stationary with respect to both the ring and the cutter.

15. The rotary drill bit of claim 13, wherein the elastomeric element comprises an O-ring.

16. A rotary drill bit comprising a bit body having at least one bearing pin attached thereto, a roller cutter which is rotatably carried on the bearing pin over a bearing system, said bearing system comprising at least a forward bearing and a rear bearing, at least one inflow passage being provided in a bit body, means for supplying fluid through the passage to the rear bearing during operation of the bit for flushing and for aiding cooling of the rear bearing, the passage terminating in the bearing system ahead of a forward end of the rear bearing between intermediate sealing means and an annular outlet gap for the fluid provided between the bit body and the roller cutter, said rear bearing being a roller bearing and the bearing pin including a radially extending flange, said sealing means separating the bearing system into a forward bearing space and a rear bearing space and sealing against a forward radial surface of the flange, the forward bearing including an axial bearing, said sealing means partially overlapping the axial bearing in an axial direction, and the forward bearing space being filled with lubricant.

17. The rotary drill bit of claim 16, wherein the axial bearing comprises a plurality of cylindrical rollers with their axes generally perpendicular to the axis of the bearing pin.

18. A rotary drill bit comprising a bit body having at least one bearing pin attached thereto, a roller cutter being rotatably carried on the bearing pin over a bearing system, said bearing system comprising at least a forward bearing and a rear bearing, at least one inflow passage being provided in the bit body, means for supplying fluid through the passage to the rear bearing during operation of the bit for flushing and for aiding cooling of the rear bearing, the bearing pin including a radially extending flange and the passage including a plurality of radially extending passages arranged in the flange, the radially extending passages terminating in the bearing system ahead of a forward end of the rear bearing between intermediate sealing means and an annular outlet gap for the fluid provided between the bit body and the roller cutter, said rear bearing being a roller bearing and said flange axially fixing a forward end of the rollers of the rear bearing, said roller cutter being axially fixed on the bearing pin by the rear bearing, said sealing means separating the bearing system into a forward bearing space and a rear bearing space, the forward bearing space being filled with lubricant.

19. The rotary drill bit of claim 18, wherein the roller cutter is axially fixed on the bearing pin by engagement of a shoulder on a rear portion of the cutter with a rear end of the rollers of the rear bearing.

* * * * *